United States Patent [19]

Bender

[11] Patent Number: 4,890,534

[45] Date of Patent: Jan. 2, 1990

[54] LUBRICATING DIE FOR CARTRIDGE RELOADER

[75] Inventor: Walter W. Bender, Oroville, Calif.

[73] Assignee: Blount, Inc., Portland, Oreg.

[21] Appl. No.: 318,008

[22] Filed: Mar. 2, 1989

[51] Int. Cl.[4] ..... F42B 31/02; F42B 33/10; F42B 11/20; F16N 1/00

[52] U.S. Cl. ..... 86/19; 86/36; 86/37; 86/23; 102/511; 184/18; 184/19

[58] Field of Search ..... 86/19, 17, 36–38; 102/430, 435, 442, 481, 511, 282; 42/90; 184/18, 19, 65, 81

[56] References Cited

U.S. PATENT DOCUMENTS

| | | | |
|---|---|---|---|
| 1,322,271 | 11/1919 | Thompson | 86/17 |
| 2,016,676 | 10/1935 | Hess | 86/25 |
| 2,019,795 | 11/1935 | Peterson | 86/19 |
| 3,398,629 | 8/1968 | Olson | 86/19 |
| 3,736,835 | 6/1973 | Hanson | 86/19 |
| 3,967,526 | 7/1976 | Leich | 86/19 |
| 4,336,865 | 6/1982 | Carkoski | 86/19 |
| 4,353,282 | 10/1982 | Holt | 86/19 |
| 4,462,298 | 7/1984 | Engles | 86/19 |
| 4,802,297 | 2/1989 | French | 42/90 |

*Primary Examiner*—Howard J. Locker
*Attorney, Agent, or Firm*—Robert L. Harrington

[57] ABSTRACT

A die used in a reloading press for reloading spent cartridges. The wall of the die is provided with a reservoir for liquid lubricant. A lubricating pad is provided inside the die mouth and lubricant from the reservoir is channeled to the pad. A primary reloading die feature is provided for the die, e.g. a primer removing rod, and as a cartridge is forced into the die for removal of the primer, it is additionally lubricated ready for resizing.

6 Claims, 3 Drawing Sheets

LUBRICATING DIE FOR CARTRIDGE RELOADER

FIELD OF THE INVENTION

This invention relates to apparatus used in the reloading of firearm cartridges, and more specifically applies to a combination die that incorporates as one of its functions a means for lubricating the external cylindrical surface area of a spent cartridge case.

BACKGROUND OF THE INVENTION

Reloading of firearm cartridges is widely practiced by individuals or groups to tailor the ammunition to their needs. Cost reduction is also a factor.

Reloading of spent firearm cartridges is accomplished by utilizing a reloading press and tooling, such as dies, to perform in a typical step-by-step procedure:

(ejection and then replacement of the primer cap in the cartridge case resizing the cartridge case loading the cartridge case with gun powder inserting and seating a bullet into the mouth of the cartridge case.

The above procedure is basic to the reloading process and is not intended to be all inclusive. The reloading of spent cartridge cases utilizing a reloading press and tooling, with their many variations, is known to the art.

An important step in the cartridge reloading process is the lubrication of the cartridge case prior to resizing. Heretofore the lubrication of the cartridge case was performed by manual application of the lubricant as a separate operation apart from the reloading press. A common practice was to roll a cartridge case on a flat rectangular absorbent pad that was impregnated with lubricant. The physical contact of the cartridge case against the pad would cause lubricant to be deposited on the cartridge case. Alternatively, a cloth was simply moistened with the lubricant and rubbed on the cartridge case.

A device for assisting the reloader in lubricating cartridge cases is disclosed in U.S. Pat. No. 3,398,629, Olson. A ring of sponge-like material containing the lubricant is confined in a circular rim. A bracket mounts the rim and sponge ring in an upright position. The cartridge cases are manually inserted into the sponge ring and lubricant is transferred o to the periphery of the case.

Some of the disadvantages incurred by using the above methods are:

a. The flat rectangular pad is generally placed on a bench where it was subject to contamination by dust, lint or other material in the work area.

b. The consistency of dampness of the lubricating pad, sponge ring or cloth is not maintained by a replenishing source such as a lubricant reservoir and, thus, the lubrication of the cases is not uniform since the degree of dampness of the lubricating pad or ring diminishes relative to the number of cartridge cases lubricated.

c. The operator's fingers invariably became coated with lubricant due to the necessity of handling the cases during the lubricating process.

d. The step of lubrication as previously practiced was an added step to the many steps that a reloader goes through in the reloading process.

BRIEF DESCRIPTION OF THE INVENTION

The present invention is believed to provide a substantially improved method for lubricating cartridge cases. A lubricating ring is incorporated into a reloading die that is used in the reloading press. Preferably the die performs an additional function such as ejecting the spent primer cap from the cartridge case. A reservoir of lubricant is provided in the die body to insure consistent application of the lubricant.

With the present invention, the separate handling of the cartridge cases for applying lubricant is eliminated. The operator simply loads the cartridges into the press in the normal manner, and in that step where the primer cap is ejected, the cartridge case is lubricated as well.

The invention will be more fully understood and appreciated by reference to the following description and drawings referred to therein.

DESCRIPTION OF THE FIGURES

Referring to the drawings, FIG. 1 illustrates a reloading apparatus 10 of known design. In general, a ram 12 includes a cartridge holder 14 that holds a cartridge case 16. As illustrated, the ram 12 is actuated as a lever 18 is manually depressed. This forces upward movement of the ram 12 and corresponding upward movement of the cartridge case 16 toward a die 20 contained in a die holder 22 that is rigidly affixed over and in line with the movement of the ram.

The above is a typical operation for apparatus for reloading spent cartridge cases. Whereas the reloading operation requires a number of die functions, the reader will understand that die 20 is interchangeable with a number of dies, each performing a specific function or functions in the reloading operation.

The present invention is directed more specifically at the provision of a lubricating feature as a secondary function for one of the dies. In a preferred embodiment of the invention, the lubricating feature is combined with a primer cap removing feature. The combination die is more specifically illustrated in FIGS. 2–7.

Figure 1:
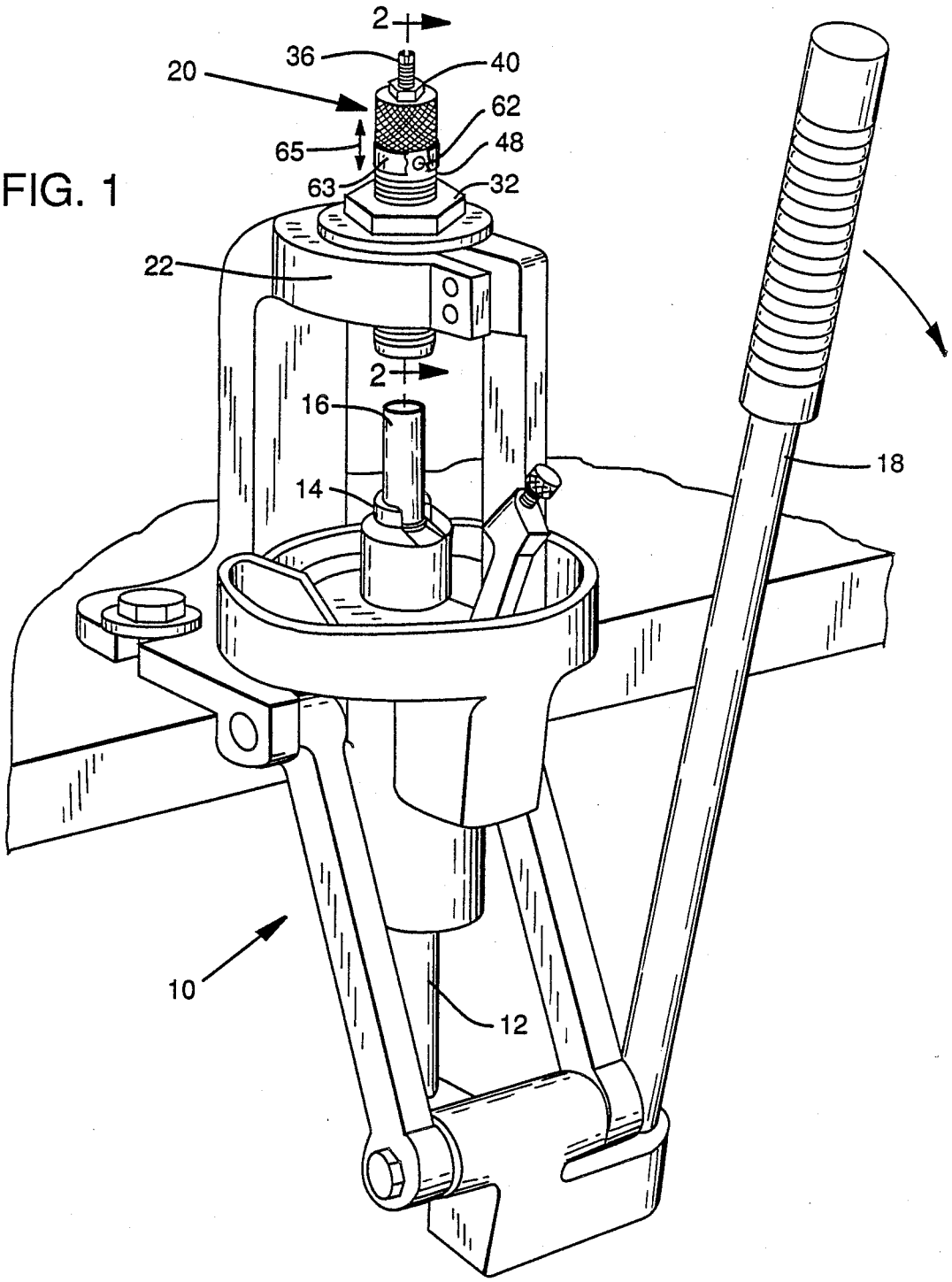
FIG. 1 is a schematic illustration of a reloading apparatus utilizing a combination die in accordance with the present invention.
Figure 2:
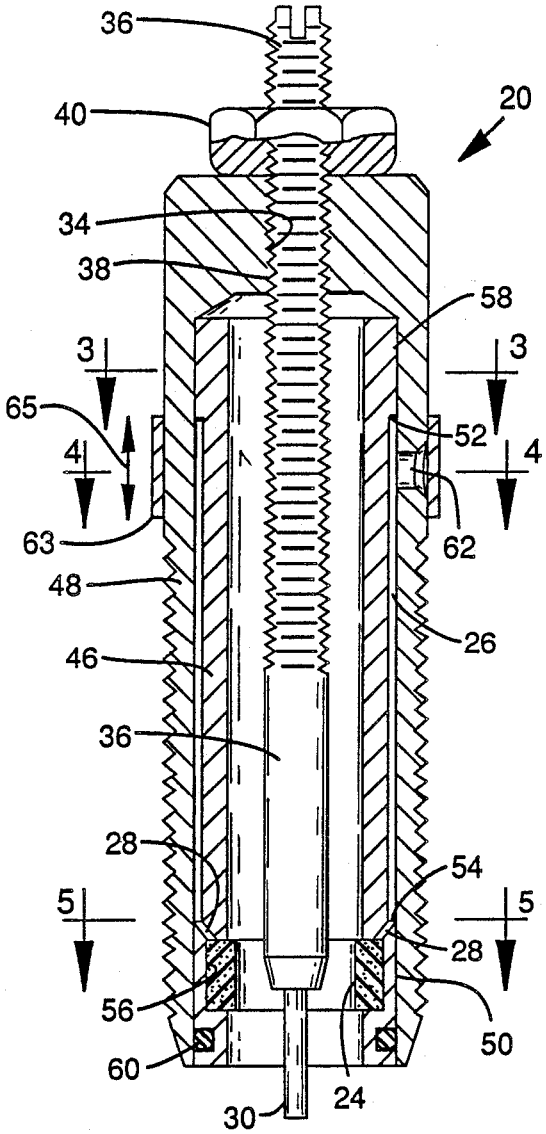
FIG. 2 is a section view of the combination die as taken on view line 2—2 of FIG. 1.
Figure 3:
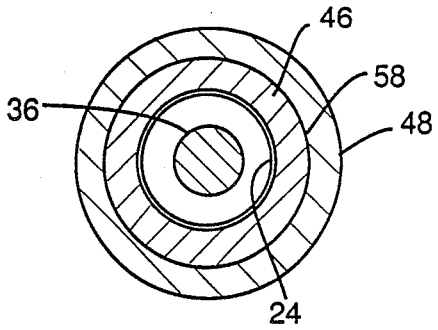
FIG. 3 is a section view as taken on view lines 3—3 of FIG. 2.
Figure 4:
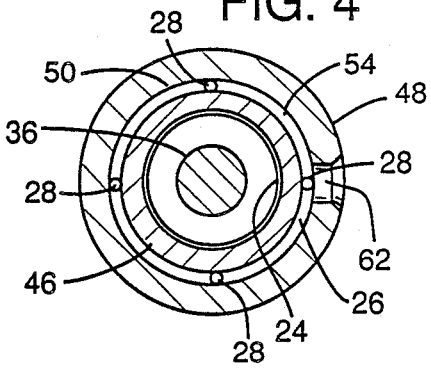
FIG. 4 is a section view as taken on view line 4—4 of FIG. 2.
Figure 5:
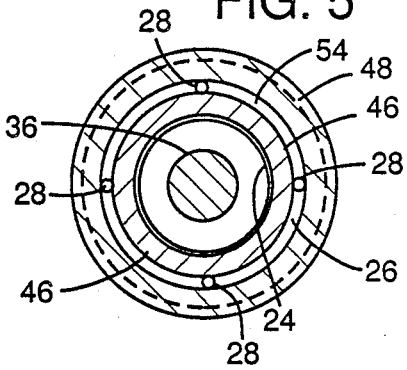
FIG. 5 is a section view as taken on view line 5—5 of FIG. 2.

The cylindrical die 20 is threaded externally to threadably fit into the die holder 22 of the reloading apparatus 10 (see FIG. 1). The die 20 is locked into position in the die holder 22 by nut 32. The upper end of the die 20 has an opening 34 that is internally threaded and is concentric to said die body.

A decapping rod 36 is externally threaded at 38 to match the internally threaded upper opening 34 in said die body. The decapping rod 36 is screwed into the upper opening 34 of die 20 until a decapping pin 30 that is affixed to the lower end of the decapping rod is at the desired position protruded from the die. At this position, the pin 30 extends through the primer cap opening of the cartridge 16 when the cartridge case 16 is fully inserted in the die to thereby push or eject a spent primer cap 39 from cartridge case 16 (see FIG. 6). The decapping rod is locked into position by nut 40.

The lubricating feature of the die 20 is provided in the die housing that includes an outer body portion 48 and a core body portion 46. These components of the die housing are illustrated in exploded view in FIG. 7.

At te lower end of the die body portion 48 is a cylindrical cavity 44. Said cylindrical cavity has a diameter and length to accept the core body portion 46. The core portion 46 has an internal diameter sufficiently large to permit the insertion of cartridge case 16. An annular inner groove 56 near the bottom of the core body portion is provided to accommodate the lubricating pad 24.

The inner diameter of the outer body portion 48 and the outer diameter at the bottom end 50 and upper end 58 of the core body portion 46 is of such dimension that a tight fit is obtained when the core body portion is installed into the cylindrical cavity 44 of said outer body portion 48. The core body portion 46 is relieved between ends 50 and 58, i.e. the external diameter is reduced at upper shoulder 52 and continues in relief to the lower shoulder 54 of the core body portion. The spacing between the outer and core body portions provided by the relieved section of the core body portion provides a reservoir 26 for lubricant. (see FIG. 2)

Multiple ports 28 extending from shoulder 54 to groove 56 are provided around the periphery of the core body portion to provide passageways between reservoir 26 and lubricating pad 24. Said ports are arranged in a manner to provide a consistent volume of and an even distribution of lubricant to the lubricating pad 24.

An aperture 62 in the outer body portion 48 is provided to facilitate the replenishment of the lubricant in reservoir 26. A slidable sealing ring 63 (FIGS. 1 and 2) is located over the aperture 22 during operation and is simply slid upward on the die body to open the aperture for replenishment. (see arrow 65) An O-ring 60 located in an external groove 67 at the lower end of the core body portion 46 insures a seal between the core body portion 46 and the outer body portion 48.

Figure 6:
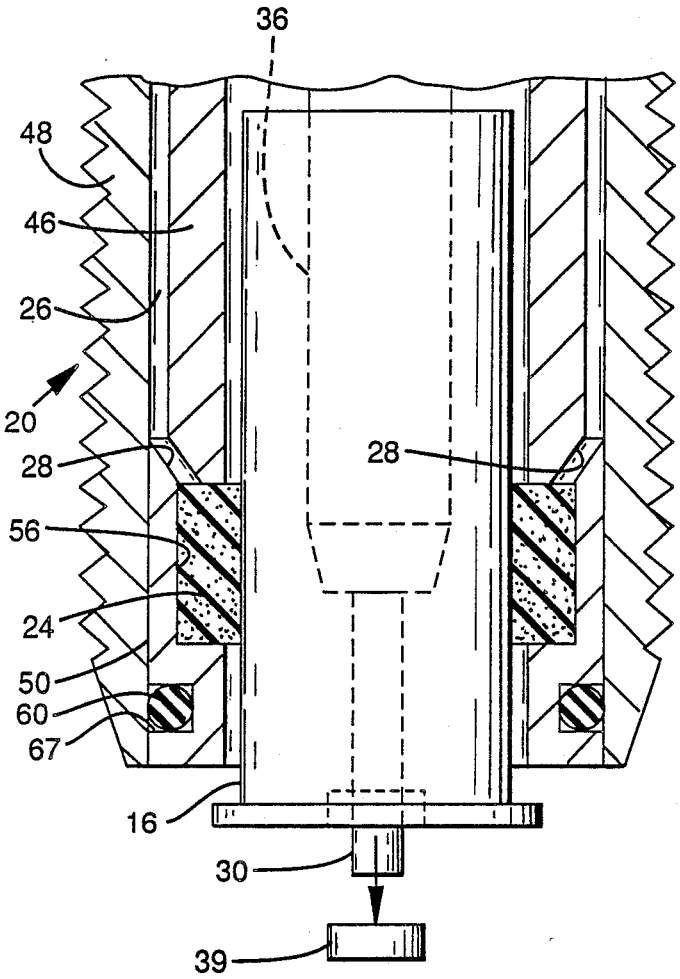
FIG. 6 is a partial view of a cartridge case being inserted into the combination die of FIG. 1.
Figure 7:
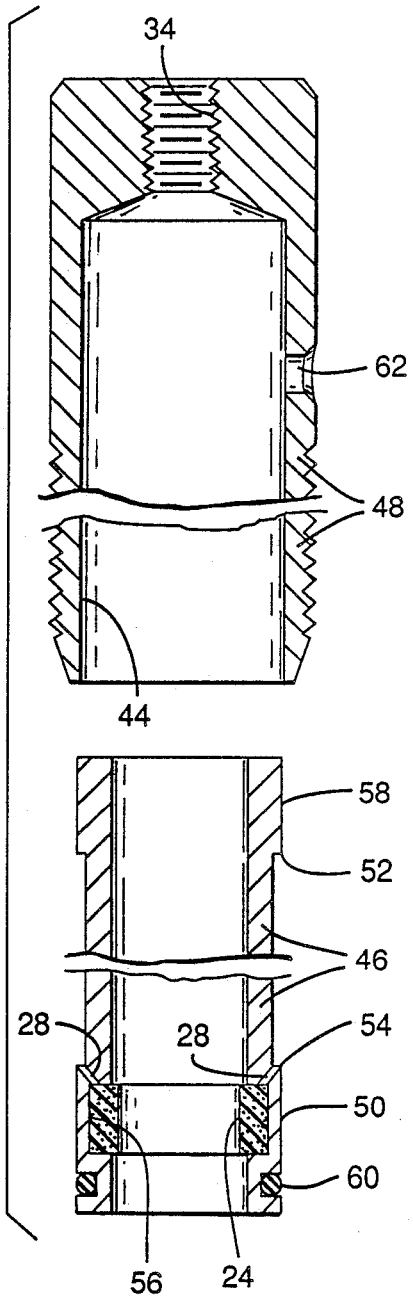
FIG. 7 is an exploded view of the two portions making up the die body or housing of the combination die of FIGS. 1–6.

From the above description, it will be understood that the combination die of the present invention provides a number of benefits. With reference to FIG. 6, it will be seen that the cartridge 16 is inserted upwardly into the inlet of the die and it passes through the ring-shaped lubricating pad 24. The ring shaped lubricating pad contains a quantity of liquified lubricant. The lubricant contained in the internal reservoir 26 of the die 20 is conveyed to the lubricating pad 24 through ports 28. Said ports are spaced around the periphery of the core body 46 at the lower shoulder section 54 and provide a passageway for lubricant flow between the reservoir 26 and the lubricating pad 24. The pad is of sponge-like or felt material that functions as a liquid receptacle. When full, or saturated, it resists further flow of the lubricant through the small diameter ports 28. As lubricant is drawn off, the pad draws down more of the lubricant from the reservoir.

The lubricating pad defines a circular opening but is sufficiently resilient to compress and allow passage of the cartridge case. The compression of the ring coupled with the physical contact with the surface of the cartridge case deposits the lubricant material onto the surface of the case 16. As the lubricant is drawn out of the lubricating pad, the pad is continuously refilled with lubricant from the reservoir to cause a uniform coating of the lubricant over the outer peripheral area of the case 16.

As the cartridge case progresses upwardly into die 20, decapping pin 30 contacts the spent primer cap 39 and dislodges it from the case. The cartridge case is now ready for the next operation.

It will be understood that the above description of the preferred embodiment is not intended to limit the scope of the invention. In particular, the lubricating feature may be considered for combination with different die functions.

It is considered unique to provide a lubricating fixture wherein a reservoir of lubricant is provided and through a series of ports supplies lubricant in a uniform manner to the lubricating pad. It is also considered unique to provide the lubricating feature as a secondary die operation. Other applications for the invention will become apparent to those skilled in the art without departing from the scope of the invention. Accordingly, the invention is to be determined based on the scope of the appended claims and not on the above description of the preferred embodiment.

What is claimed is:

1. A lubricating die for lubricating a cartridge case in a cartridge reloading operation comprising; a housing having a cavity and a bottom entry to the cavity for receiving a spent cartridge case directed upwardly through the entry, a ring-shaped lubricating pad mounted in the entry of the cavity and configured to fully encircle and slide over the cartridge case periphery upon insertion of the cartridge case into the cavity, a reservoir in the housing positioned above the entry and liquid lubricant in the reservoir, and multiple ports in the housing between the reservoir and lubricating pad, said ports arranged around the lubricating pad periphery to direct gravity flow of the liquid lubricant from the reservoir to the lubricating pad to achieve uniform wetting of the lubricating pad and thereby uniform coating of the cartridge case periphery.

2. A lubricating die for lubricating a cartridge case in a cartridge reloading operation comprising; a die body having a center cavity and a bottom inlet to the cavity, a lubricating pad surrounding the inlet to contact the encircled periphery of a cartridge case inserted into the die body cavity, automatic control means for uniformly applying liquid lubricant to the pad and through contact of the lubricating pad with the cartridge case, uniformly applying lubricant to the cartridge case periphery, means for mounting the die body in a cartridge reloading apparatus wherein cartridge cases are sequentially forced into the die body during a reloading operation, said die body incorporating a primary reloading die feature whereby as the cartridge case is forced into the die body cavity, the cartridge case is coated with the liquid lubricant as a secondary die function.

3. A lubricating die as defined in claim 2 wherein the automatic control means includes a reservoir provided in the die body above the inlet and a passageway that interconnects the reservoir with the lubricating pad for gravity flow of the liquid lubricant to the pad in the inlet.

4. A lubricating die as defined in claim 3 wherein multiple ports provide the passage way, said multiple ports arranged to uniformly wet the surface of the lubricating pad contacting the periphery of the cartridge case.

5. A lubricating die as defined in claim 4 wherein the die has a housing comprised of an outer body portion and a core body portion, said core body portion having a section that is inset from the wall of the outer body portion to form therebetween the reservoir for the lubricant said inner core body portion further having a groove for the lubricating ring-shaped pad positioned at the inlet to the cavity, said ports formed within the core body portion between said inset section and the lubricating pad.

6. A lubricating pad as defined in claim 2 wherein the die body includes a center pin projecting out of the inlet whereby the pin unseats a spent primer cap contained in the cartridge case, said unseating of the primer cap being the additional die function.

* * * * *